US010514634B2

(12) United States Patent
Hirakawa et al.

(10) Patent No.: US 10,514,634 B2
(45) Date of Patent: Dec. 24, 2019

(54) IMAGE FORMING DEVICE HAVE A REDUCING ELEMENT REDUCES AN AMOUNT OF CURRENT TO A FACE-FORMING MEMBER UPSTREAM OF A TRANSFER REGION

(71) Applicant: FUJI XEROX CO., LTD., Tokyo (JP)

(72) Inventors: Noboru Hirakawa, Kanagawa (JP); Yoko Miyamoto, Kanagawa (JP); Yasuhiro Shimada, Kanagawa (JP); Kazuyoshi Hagiwara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/945,948

(22) Filed: Apr. 5, 2018

(65) Prior Publication Data

US 2019/0056682 A1 Feb. 21, 2019

(30) Foreign Application Priority Data

Aug. 17, 2017 (JP) ..... 2017-157343

(51) Int. Cl.
*G03G 15/16* (2006.01)
*G03G 15/00* (2006.01)

(52) U.S. Cl.
CPC ..... *G03G 15/16* (2013.01); *G03G 15/1675* (2013.01); *G03G 15/1695* (2013.01); *G03G 15/5029* (2013.01)

(58) Field of Classification Search
CPC ..... G03G 15/16
USPC ..... 399/297
See application file for complete search history.

(56) References Cited

U.S. PATENT DOCUMENTS 4,491,407 A * 1/1985 Mitsuyama ..... G03G 15/169 399/316
2017/0060041 A1* 3/2017 Aiba ..... G03G 15/1615

FOREIGN PATENT DOCUMENTS

| | | |
|---|---|---|
| JP | 2000-019854 A | 1/2000 |
| JP | 2005-008344 A | 1/2005 |
| JP | 2007-057715 A | 3/2007 |

* cited by examiner

*Primary Examiner* — Walter L Lindsay, Jr.
*Assistant Examiner* — Philipmarcus T Fadul
(74) *Attorney, Agent, or Firm* — Sughrue Mion, PLLC

(57) ABSTRACT

An image forming device includes an image carrier, a transfer device, a face-forming member, and a reducing element. The image carrier carries an image. The transfer device is disposed in contact with the image carrier, transports a recording medium, and applies a transfer voltage to a transfer region between the transfer device and the image carrier to transfer the image on the image carrier to the recording medium. The face-forming member is disposed in contact with a back face of the image carrier further upstream than the transfer region, is provided grounded along a direction intersecting the movement direction of the image carrier, and includes a conductive member forming a movement track face of the image carrier leading to the transfer region. The reducing element is provided on a current path going through the face-forming member, and reduces an amount of current leading from the face-forming member to ground.

14 Claims, 13 Drawing Sheets

IMAGE FORMING DEVICE HAVE A REDUCING ELEMENT REDUCES AN AMOUNT OF CURRENT TO A FACE-FORMING MEMBER UPSTREAM OF A TRANSFER REGION

CROSS-REFERENCE TO RELATED APPLICATIONS

This application is based on and claims priority under 35 USC 119 from Japanese Patent Application No. 2017-157343 filed Aug. 17, 2017.

BACKGROUND

Technical Field

The present invention relates to an image forming device.

SUMMARY

According to an aspect of the invention, there is provided an image forming device provided with: a thin-walled image carrier that movably carries an image formed by charged imaging particles; a transfer device, disposed in contact with an image-carrying face of the image carrier, that transports a recording medium held between the transfer device and the image carrier, and in addition, applies a transfer voltage to a transfer region between the transfer device and the image carrier to thereby cause the image held on the image carrier to be transferred to the recording medium; a face-forming member, disposed in contact with a back face of the image carrier further on an upstream side in a movement direction of the image carrier than the transfer region of the transfer device, the face-forming member being provided grounded along a direction intersecting the movement direction of the image carrier, and including a conductive member that forms a movement track face of the image carrier leading to the transfer region; and a reducing element, provided on a current path going through the face-forming member, that reduces an amount of current leading from the face-forming member to ground.

BRIEF DESCRIPTION OF THE DRAWINGS

Exemplary embodiments of the present invention will be described in detail based on the following figures, wherein:

FIGS. 7A to 7C schematically illustrate a transfer operation sequence with respect to low-resistance paper in the secondary transfer unit by the image forming device according to Exemplary Embodiment 1, in which FIGS. 7A to 7C are explanatory diagrams illustrating the state before the trailing end of a paper sheet passes through a guide chute, the state after the trailing end of the paper sheet passes through the guide chute, and the state while the trailing end of the paper sheet is passing through a secondary transfer region, respectively;

FIGS. 8A to 8C schematically illustrate a transfer operation sequence with respect to low-resistance paper in the secondary transfer unit by the image forming device according to Comparative Embodiment 1, in which FIGS. 8A to 8C are explanatory diagrams illustrating the state before the trailing end of a paper sheet passes through a guide chute, the state after the trailing end of the paper sheet passes through the guide chute, and the state while the trailing end of the paper sheet is passing through a secondary transfer region, respectively;

DETAILED DESCRIPTION

Overview of Exemplary Embodiments

Figure 1:
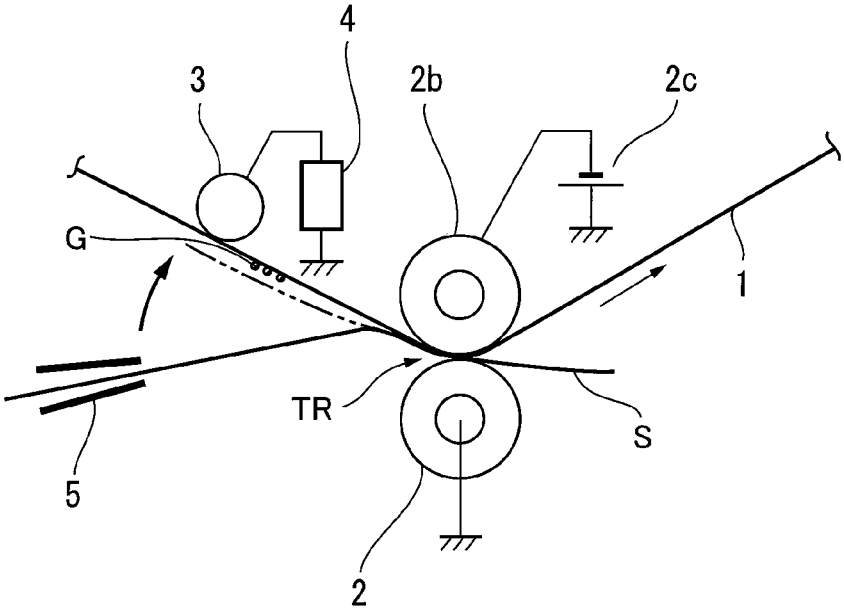
FIG. 1 is an explanatory diagram illustrating an overview of an exemplary embodiment of an image forming device to which the present invention is applied.

FIG. 1 is an explanatory diagram illustrating an overview of an exemplary embodiment of an image forming device to which the present invention is applied.

In the diagram, the image forming device is provided with:

a thin-walled image carrier 1 that movably carries an image G formed by charged imaging particles;

a transfer device 2, disposed in contact with an image-carrying face of the image carrier 1, that transports a recording medium S held between the transfer device 2 and the image carrier 1, and in addition, applies a transfer voltage to a transfer region TR between the transfer device 2 and the image carrier 1 to thereby cause the image G held on the image carrier 1 to be transferred to the recording medium S;

a face-forming member 3, disposed in contact with a back face of the image carrier 1 further on an upstream side in a movement direction of the image carrier 1 than the transfer region TR of the transfer device 2, the face-forming member 3 being provided grounded along a direction intersecting the movement direction of the image carrier 1, and including a conductive member that forms a movement track face of the image carrier 1 leading to the transfer region TR; and a reducing element 4, provided on a current path going through the face-forming member 3, that reduces an amount of current leading from the face-forming member 3 to ground.

Note that in FIG. 1, in the transfer device 2, an opposing electrode 2*b* is disposed on the back face of the image carrier 1 facing opposite the transfer device 2, and by applying a transfer voltage from a power source 2*c* to the opposing electrode 2*b*, the transfer device 2 forms a transfer electric field for transferring an image in the transfer region TR.

In such a technical configuration, the exemplary embodiment is effective for a recording medium S of low resistance compared to plain paper having a sheet resistance from $10^{10}$ to $10^{12}\Omega/\square$, for example. However, the configuration is not limited thereto, and obviously the exemplary embodiment may also be applied to a recording medium S of some other type.

Also, insofar as the image carrier 1 holds the image G, the intermediate transfer body also broadly includes a dielectric. Also, the form of the image carrier 1 is not limited to being belt-shaped, and may also include a thin-walled drum shape.

Furthermore, insofar as the transfer device 2 is disposed in contact with the image carrier 1, the transfer device 2 broadly includes roller-shaped device, belt-shaped devices spanning across tension members, and the like. The transfer device 2 is not limited to a method in which power is supplied from the opposing electrode 2*b* side, and also includes any methods in which power is supplied from the transfer device 2 side.

Furthermore, the face-forming member 3 forms a movement track face on the image carrier 1 leading to the transfer region TR of the transfer device 2, and may be provided statically in a predetermined position, or the movement track face of the image carrier 1 with respect to the recording medium S may be changed to an optimal position in accordance with a change in the type of the recording medium S or the disposed position of the transfer device 2.

Also, the reducing element 4 broadly includes any element that reduces the amount of current, and obviously may be a resistance element connectible to the face-forming member 3, but may also be a resistance element that covers the surface of the face-forming member 3 (high-resistance covering layer), a current control element such as a diode that restricts current flow, an inverse-polarity power source, or the like.

According to the present exemplary embodiment, when the recording medium S is guided by a running guide member 5 and reaches the transfer region TR by being guided to the image carrier 1 after contacting the image carrier 1 in front of the transfer region TR of the transfer device 2, in the case in which the trailing end of the recording medium S passes through the running guide member 5, although the trailing end of the recording medium S jumps up and contacts the surface of the image carrier 1, the state of contact with the image carrier 1 is unstable, and there is a risk of a tiny gap occurring between the trailing end of the recording medium S and the image carrier 1.

At this time, assuming that the recording medium S being used is a low-resistance recording medium S having lower sheet resistance than plain paper, part of the transfer current of the transfer device 2 more easily flows along a conductive path leading across the surface of the recording medium S from the face-forming member 3 to ground. Meanwhile, the existence of a tiny gap between the trailing end of the recording medium S and the image carrier 1 may cause an electric discharge to occur at the location of the tiny gap, which correspondingly imparts fluctuations to the charge amount of the image G formed by charged imaging particles on the image carrier 1, and there is a risk that the optimal transfer voltage may shift. For this reason, when the charged-up image G reaches the transfer region TR of the transfer device 2, even if a transfer electric field produced by a transfer voltage at a predetermined constant voltage level is operative, the electrostatic adhesive force of the charged imaging particles (such as toner) forming the image G on the image carrier 1 has become stronger, and to the same extent, the charged-up image G is more resistant to transfer to the recording medium S side, and a tendency is observed in which the image density is lowered at the trailing end of the recording medium S.

The exemplary embodiment addresses such a phenomenon of lowered image density, and since the reducing element 4 that reduces the amount of current on the conductive path leading from the face-forming member 3 to ground is provided, even if the recording medium S is disposed in contact with the image carrier 1 between the transfer region TR of the transfer device 2 and the face-forming member 3, the flow of part of the transfer current along a conductive path leading across the surface of a low-resistance recording medium S from the face-forming member 3 to ground becomes smaller compared to the case in which the reducing element 4 is not provided. As a result, even if a tiny gap occurs between the trailing end of the recording medium S and the image carrier 1, an electric discharge does not occur in the location of the tiny gap, and there is little to no risk of imparting fluctuations to the charge amount of the image G on the image carrier 1 corresponding to the trailing end of the recording medium S. For this reason, as described above, the phenomenon of lowered image density at the trailing end of the recording medium S is effectively avoided.

Next, representative or preferable modes of an image forming device according to the present exemplary embodiment will be described.

First, a representative mode of the reducing element 4 is a mode that interposes a resistance element between the face-forming member 3 and ground. This example is a mode in which, by using a resistance element with a predetermined resistance condition, it is possible to set the system resistance including the face-forming member 3 to a designated value.

An effective mode of this type of the reducing element 4 is one in which the reducing element 4 has a resistance value greater than the resistance value of the transfer device 2. In this example, by choosing a resistance element having a greater resistance value than the transfer device 2 as the resistance condition of the resistance element, the system resistance including the reducing element 4 (the combined resistance of the reducing element 4+the image carrier 1+the opposing electrode 2*b*) is set to a substantially higher resistance than the system resistance of the transfer region TR (the combined resistance of the transfer device 2+the image carrier 1+the opposing electrode 2*b*).

Furthermore, an effective mode of this type of the reducing element 4 is one in which the reducing element 4 has a resistance value that is five times or more than the resistance value of the transfer device 2. This example enables the selection of a resistance condition sufficient for the resistance element based on the resistance value of the transfer device 2. This is based on the results illustrated in a working example described later.

Furthermore, another effective mode of the reducing element 4 is one in which the reducing element 4 has a resistance value greater than the resistance value of the recording medium S. In this example, by setting the resistance element acting as the reducing element 4 to a resistance value greater than the resistance value of the recording medium S, even if the recording medium S contacts the image carrier 1, the current that leaks from the recording medium S to the face-forming member 3 is reduced by the resistance element.

Also, a representative pre-transfer movement track of the recording medium is a mode in which the recording medium S is guided to the transfer region TR along the image carrier 1 after making contact further on the upstream side of the movement direction of the image carrier 1 than the transfer region TR, via the running guide member 5 disposed further on the upstream side in a transport direction than the transfer region TR of the transfer device 2. This example is a mode in which the recording medium S is guided to the transfer region TR of the transfer device 2 along the image carrier 1 after making contact with the image carrier 1 via the running guide member 5.

An effective mode of this type of pre-transfer movement track is one in which the recording medium S is guided to the transfer region TR along the image carrier 1 after making contact further on the upstream side of the movement direction of the image carrier 1 than the transfer region TR of the transfer device 2 and also further on the downstream side of the movement direction of the image carrier 1 than the face-forming member 3. This example is a mode in which the recording medium S is guided along the image carrier 1 after making contact in an intermediate region of the image carrier 1 between the face-forming member 3 and the transfer region TR of the transfer device 2.

Furthermore, a desirable mode of this type of pre-transfer movement track is one in which, after passing through the running guide member 5, a trailing end part of the recording medium S makes contact facing a part of the image carrier 1 facing opposite the face-forming member 3. In this example, if recording medium S passes through the running guide member 5 and the trailing end part in the transport direction of the recording medium S jumps up, the trailing end part of the recording medium S contacts the image carrier 1, but if the contact site of the trailing end part of the recording medium S is at a position facing the face-forming member 3, even if the trailing end part of the recording medium S strongly contacts the image carrier 1, a situation in which unwanted vibrations are produced in the image carrier 1 is inhibited.

Also, a representative mode of the low-resistance recording medium S is a medium having a predetermined resistance value or less, or having a conductive layer along the medium substrate face. In this example, in the case of using the low-resistance recording medium S, current may try to flow along the conductive layer, but since the face-forming member 3 is equipped with the reducing element 4, current is inhibited from leaking out from the face-forming member 3.

Furthermore, as an applied example applied to an image forming device of the intermediate transfer method, the image carrier 1 is an intermediate transfer body onto which an image on an image-forming carrier (not illustrated) is intermediately transferred and held before being transferred to the recording medium S, and the transfer device 2 transfers the image G on the intermediate transfer body onto the recording medium S.

An effective example of the installation of the reducing element 4 is one in which, when the recording medium S is of low resistance having a predetermined resistance value or less, or having a conductive layer along a medium substrate face, the reducing element 4 is selectively switched to a current path leading from the face-forming member 3 to ground. This example is one that selectively switches the reducing element 4 with respect to the face-forming member 3, according to the type of the recording medium S.

Herein, a representative mode of selectively switching the reducing element 4 is one that includes a medium discriminator that discriminates whether or not the recording medium S is of low resistance having a predetermined resistance value or less, or having a conductive layer along a medium substrate face, and a switch mechanism that selectively switches the reducing element 4 to a current path leading from the face-forming member 3 to ground when the medium discriminator discriminates that the recording medium S is of low resistance.

This example is a mode that includes a medium discriminator and a switch mechanism, and obviously the medium discriminator may discriminate by measuring the resistance of the recording medium S during transport, or the recording medium S in use may be discriminated by being specified by a user. Also, the switch mechanism may be a switch element that toggles the reducing element 4, for example.

Hereinafter, the present invention will be described in detail on the basis of the exemplary embodiments illustrated in the accompanying drawings.

Exemplary Embodiment 1

Figure 2:
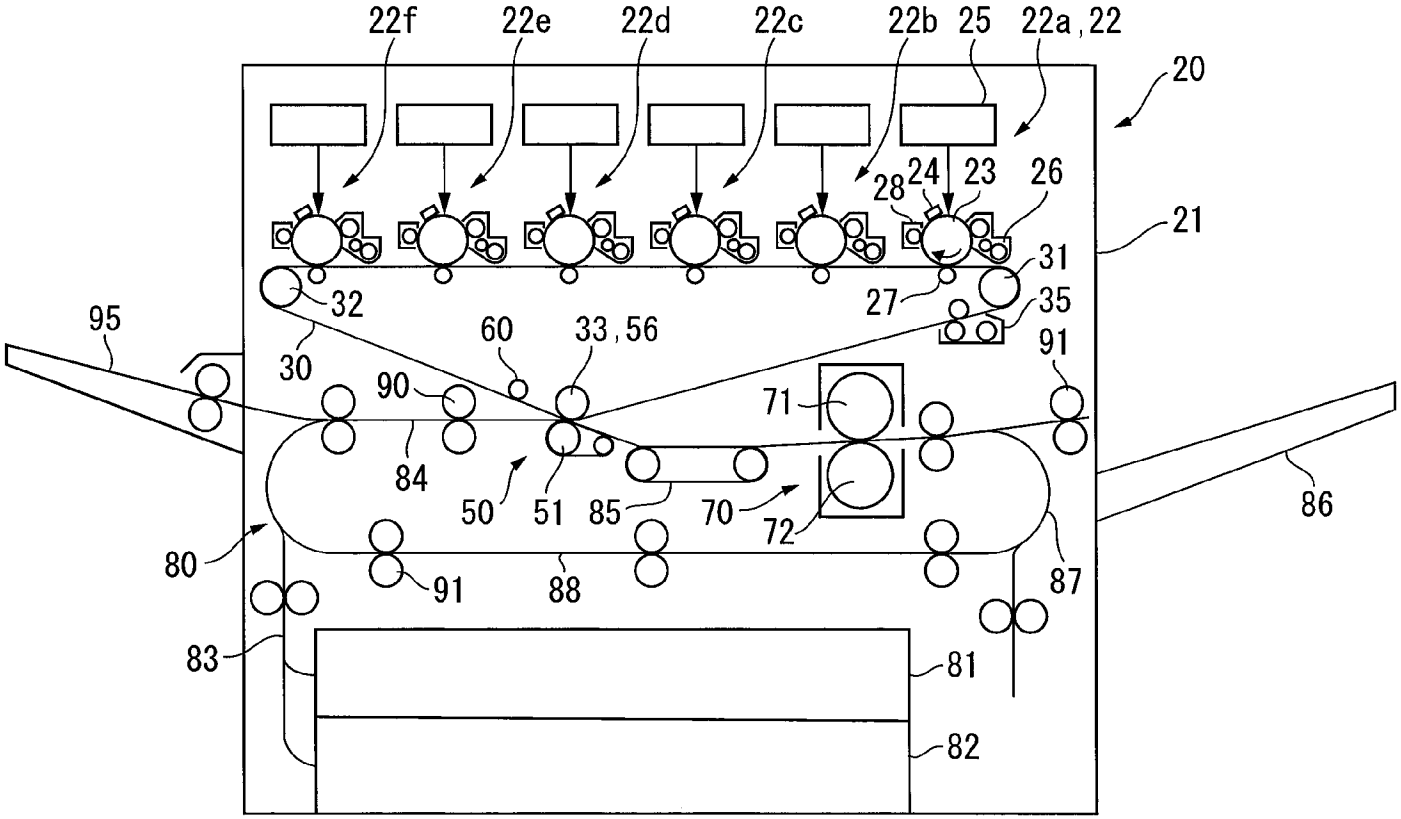
FIG. 2 is an explanatory diagram illustrating an overall configuration of the image forming device according to Exemplary Embodiment 1.

FIG. 2 illustrates an overall configuration of the image forming device according to Exemplary Embodiment 1.

—Overall Configuration of Image Forming Device—

In the diagram, an image forming device 20 is provided with image forming units 22 (specifically, 22*a* to 22*f*) that form images of multiple color components (in the present exemplary embodiment, White #1, Yellow, Magenta, Cyan, Black, and White #2), a belt-shaped intermediate transfer body 30 that successively transfers (a first transfer) and holds each color component image formed by each image forming unit 22, a secondary transfer device (lump transfer device) 50 that performs a secondary transfer (lump transfer)

of each color component image transferred on the intermediate transfer body 30 onto a paper sheet S that acts as a recording medium, a fusing device 70 that fuses the secondarily transferred image onto the paper sheet S, and a paper transport system 80 that transports the paper sheet S to a secondary transfer region. The above components are provided inside an image forming device housing 21. Note that in this example, a white color material of the same color is used for White #1 and White #2, but obviously different white color materials may also be used depending on whether the color material is positioned in a higher or lower layer than another color component image on the paper sheet S. In addition, a transparent color material may also be used instead of one of the white colors, such as White #1, for example.

—Image Forming Units—

In the present exemplary embodiment, each image forming unit 22 (22*a* to 22*f*) includes a drum-shaped photoreceptor 23. Around the periphery of each photoreceptor 23, there are disposed a charging device 24 such as a corotron or a transfer roller that charges the photoreceptor 23, an exposure device 25 such as a laser scanning device that writes an electrostatic latent image onto the charged photoreceptor 23, a development device 26 that develops the electrostatic latent image written onto the photoreceptor 23 with toner of each color component, a first transfer device 27 such as a transfer roller that transfers the toner image on the photoreceptor 23 onto the intermediate transfer body 30, and a photoreceptor cleaning device 28 that removes residual toner on the photoreceptor 23.

Also, the intermediate transfer body 30 spans across multiple (in the present exemplary embodiment, three) tension rollers 31 to 33. For example, the tension roller 31 is used as a drive roller that is driven by a driving motor (not illustrated), and the intermediate transfer body 30 is made to move in a cyclical manner by the drive roller. Furthermore, an intermediate transfer body cleaning device 35 for removing residual toner on the intermediate transfer body 30 after the secondary transfer is provided between the tension rollers 31 and 33.

—Secondary Transfer Device (Lump Transfer Device)—

Figure 3:
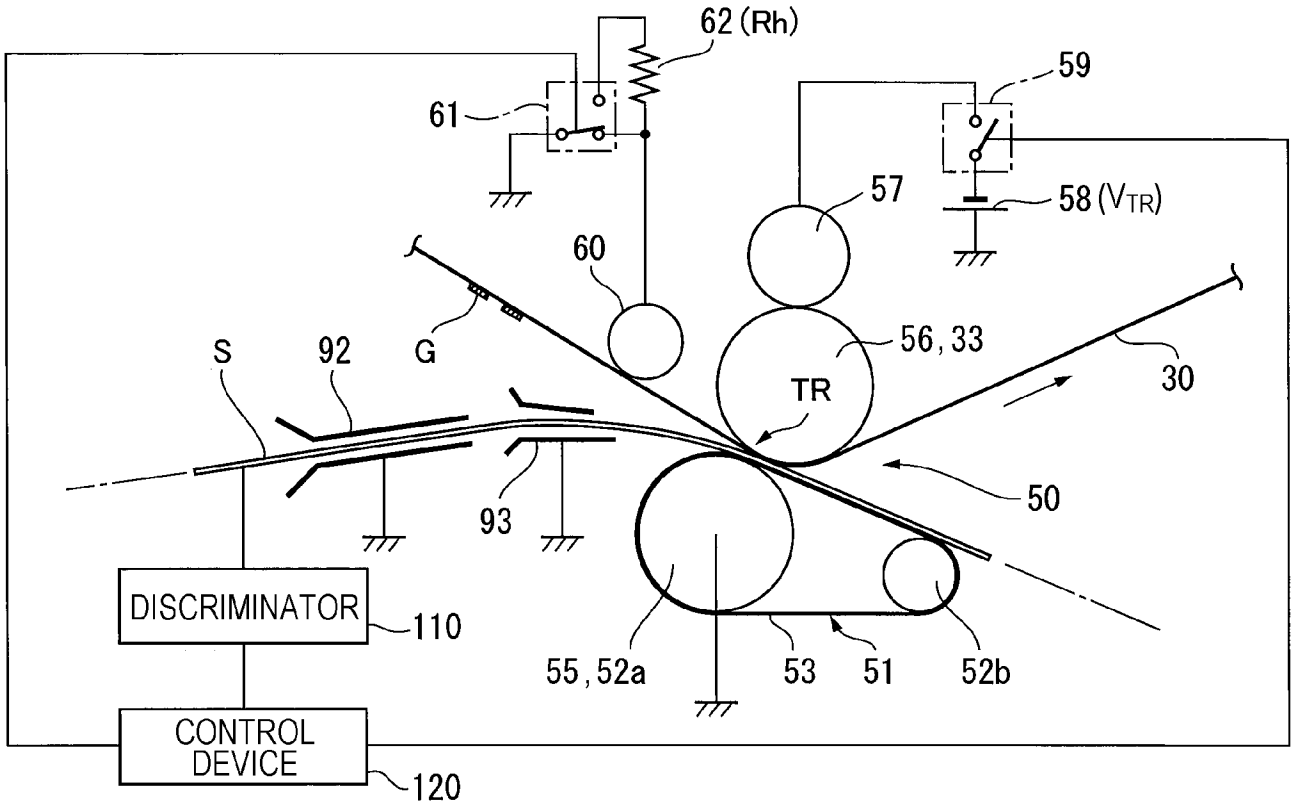
FIG. 3 is an explanatory diagram illustrating details of a configuration around a secondary transfer unit of the image forming device illustrated in FIG. 2.

Additionally, as illustrated in FIGS. 2 and 3, the secondary transfer device (lump transfer device) 50 is disposed so that a belt transfer module 51 (corresponding to the transfer device 2 illustrated in FIG. 1), in which a transfer transport belt 53 is stretched across multiple (for example, two) tension rollers 52 (specifically, 52*a* and 52*b*), contacts the surface of the intermediate transfer body 30.

Herein, the transfer transport belt 53 is a semiconducting belt with a volume resistivity from $10^6$ to $10^{12}$ Ωcm using a material such as chloroprene. One tension roller 52*a* is configured as an elastic transfer roller 55, and this elastic transfer roller 55 is disposed pressed against the intermediate transfer body 30 through the transfer transport belt 53 in the secondary transfer region (lump transfer region). In addition, the tension roller 33 of the intermediate transfer body 30 is disposed opposite as an opposing roller 56 that forms an opposing electrode with respect to the elastic transfer roller 55, thereby forming a transport path for the paper sheet S proceeding from the position of the one tension roller 52*a* towards the position of the other tension roller 52*b*.

Additionally, in this example, the elastic transfer roller 55 is configured so that the circumference of a metal shaft is covered by an elastic layer in which carbon block or the like has been blended into urethane foam rubber or EPDM.

Furthermore, a transfer bias $V_{TR}$ is applied from a transfer power source 58 to the opposing roller 56 (which also doubles as the tension roller 33 in this example) via a conductive power supply roller 57. Meanwhile, the elastic transfer roller 55 (one of the tension rollers 52*a*) is grounded via a metal shaft (not illustrated), and a designated transfer electric field is made to be formed between the elastic transfer roller 55 and the opposing roller 56. Note that the other tension roller 52*b* is also grounded, thereby discouraging the accumulation of charge in the transfer transport belt 53. Also, if the peelability of the paper sheet S at the downstream end of the transfer transport belt 53 is taken into consideration, it is effective to make the diameter of the tension roller 52*b* on the downstream side smaller than the tension roller 52*a* on the upstream side. Note that the sign 59 denotes a power source switch connected in series to the power supply roller 57 and the transfer power source 58.

—Face-Up Roller—

In the present exemplary embodiment, as illustrated in FIGS. 2 and 3, on the upstream side in the movement direction of the intermediate transfer body 30 with respect to the secondary transfer region TR, a rotatable face-up roller 60 is installed on the back face closer to the tension roller 33 in the part positioned between the tension rollers 32 and 33, thereby forming a movement track face of the intermediate transfer body 30 leading to the secondary transfer region TR. The face-up roller 60 may be provided in a fixed state at a predetermined position, or may be provided capable of advancing or retreating along a direction (for example, the thickness direction of the intermediate transfer body 30) that intersects the movement direction of the intermediate transfer body 30 depending on the type of the paper sheet S. Herein, in the mode in which the face-up roller 60 advances or retreats, it is sufficient to reduce the curvature of the intermediate transfer body 30 of the secondary transfer region TR as the paper sheet S becomes thicker. For example, when the paper sheet S is thick paper, and the paper sheet S contacts the intermediate transfer body 30 in front of the secondary transfer region TR and then enters the secondary transfer region TR, it is possible to reduce the load variation on the intermediate transfer body 30.

<Grounding Condition of Face-Up Roller>

Furthermore, in the present exemplary embodiment, the face-up roller 60 is made of a conductive material such as metal, and as illustrated in FIG. 3, as a grounding condition, by going through a toggle switch 61, the face-up roller 60 is selectively switched between being grounded at high resistance by being grounded through a high resistance 62 with a predetermined resistance value Rh, or being grounded at low resistance by being grounded directly, without going through the high resistance 62.

As for the resistance value Rh of the high resistance 62 herein, a resistance value that is at least greater than the combined resistance of the belt transfer module 51 of the secondary transfer device 50, specifically the combined resistance of the elastic transfer roller 55 and the transfer transport belt 53, is sufficient. In other words, in this example, since the transfer bias $V_{TR}$ is applied from the opposing roller 56 side, and the combined resistance of the opposing roller 56, the intermediate transfer body 30, and the belt transfer module 51 is taken to be the system resistance $R_{SYS}$ of the secondary transfer region TR, if the system resistance $R_{SYS1}$ including the high resistance 62 of the face-up roller 60 (the combined resistance of the opposing roller 56, the intermediate transfer body 30, and the high resistance 62) is greater than the system resistance $R_{SYS}$ of the secondary transfer region TR to thereby satisfy the relationship ($R_{SYS1}>R_{SYS}$), the secondary transfer device 50 is capable of making an adjustment so that part of the transfer current flowing to the secondary transfer region TR is less likely to flow as a leakage current from the face-up roller 60 side.

However, even if the relationship $R_{SYS1}>R_{SYS}$ is hypothetically satisfied, when a low-resistance paper sheet S having a lower sheet resistance than plain paper is used, if a situation occurs in which the low-resistance paper sheet S is disposed stretched over the site fronting the secondary transfer region TR and the face-up roller 60, the low-resistance paper sheet S becomes a conductive path. Thus, for the resistance value Rh of the high resistance 62 of the face-up roller 60 that contributes to the system resistance $R_{SYS1}$, a resistance that is at least sufficiently greater than the sheet resistance of the low-resistance paper sheet S is desirable, and a resistance that is several multiples of the system resistance $R_{SYS}$ of the secondary transfer region TR, such as five times or more, may be set.

Note that in this example, a mode is adopted in which the low-resistance grounding is a direct grounding, but the configuration is not limited thereto, and the face-up roller 60 may also be grounded through a low resistance whose resistance value is sufficiently lower than the high resistance 62 (for example, 100 MΩ or less).

<Exemplary High-Resistance Grounding Structure of Face-Up Roller>

Figure 5A:
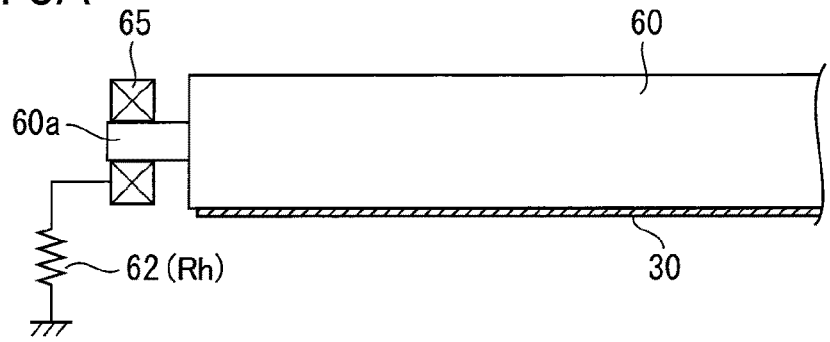
FIG. 5A is an explanatory diagram illustrating an example of high-resistance grounding of a face-up roller of an image forming device according to Exemplary Embodiment 1.

Also, as an exemplary high-resistance grounding using the high resistance 62, as illustrated in FIG. 5A, since the support structure of the face-up roller 60 is a mode that rotatably supports a rotating shaft 60*a* on a bearing 65, a method that interposes the high resistance 62 between the bearing 65 and ground is often adopted. Note that since it is sufficient for the high resistance 62 to be provided on the conductive path that leads from the face-up roller 60 to ground, the high resistance 62 may also be interposed at the place of contact between the bearing 65 and the rotating shaft 60*a* of the face-up roller 60.

Figure 5B:
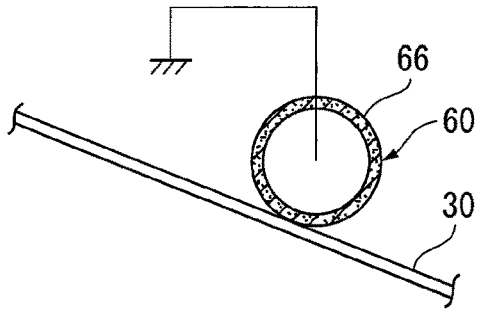
FIG. 5B is an explanatory diagram illustrating another example of high-resistance grounding of the face-up roller.

Furthermore, as another example of high-resistance grounding, as illustrated in FIG. 5B, the surface of the face-up roller 60 may also be covered by a high-resistance covering layer 66.

—Fusing Device—

The fusing device 70 includes a drivably rotatable heat-fusing roller 71 disposed to contact the face on the image-holding side of the paper sheet S, and a pressure-fusing roller 72 which is disposed to press against the heat-fusing roller 71, and which rotates to track the heat-fusing roller 71. The fusing device 70 causes the image held on the paper sheet S to pass through the transfer region between the fusing rollers 71 and 72, and fuses the image by applying heat and pressure.

—Paper Transport System—

Furthermore, as illustrated in FIGS. 2 and 3, the paper transport system 80 includes multiple (in this example, two stages) paper supply containers 81 and 82. The paper sheet S supplied from either of the paper supply containers 81 and 82 is transported from a vertical transport path 83 extending in an approximately vertical direction through a horizontal transport path 84 extending in an approximately horizontal direction to reach the secondary transfer region TR. After that, the paper sheet S holding a transferred image is transported via a transport belt 85 to the site of fusing by the fusing device 70, and is delivered into a paper delivery receptacle 86 provided on a side face of the image forming device housing 21.

In addition, the paper transport system 80 includes a reversing branch transport path 87 that branches downward from the portion on the downstream side of the fusing device 70 in the paper transport direction as part of the horizontal transport path 84. A paper sheet S reversed by the branch transport path 87 again returns to the horizontal transport path 84 from the vertical transport path 83 via a return transport path 88, and an image is transferred onto the back face of the paper sheet S at the secondary transfer region TR. The paper sheet S then passes through the fusing device 70 and is delivered into the paper delivery receptacle 86.

Also, the paper transport system 80 is provided with registration rollers 90 that align and supply the paper sheet S to the secondary transfer region TR, as well as an appropriate number of transport rollers 91 in each of the transport paths 83, 84, 87, and 88. Additionally, on the entrance side of the secondary transfer region TR of the horizontal transport path 84, guide chutes 92 and 93 that guide the paper sheet S to the secondary transfer region TR are provided, and each of the guide chutes 92 and 93 is grounded. Moreover, on the side of the image forming device housing 21 opposite from the paper delivery receptacle 86, a manual feed paper supplier 95 enabling the manual feeding of paper into the horizontal transport path 84 is provided.

—Paper Types—

Examples of the paper sheet S which are usable in this example obviously include plain paper having a sheet resistance from $10^{10}$ to $10^{12}$Ω/□, for example, as well as low-resistance paper having a lower sheet resistance than plain paper.

Figure 4A:
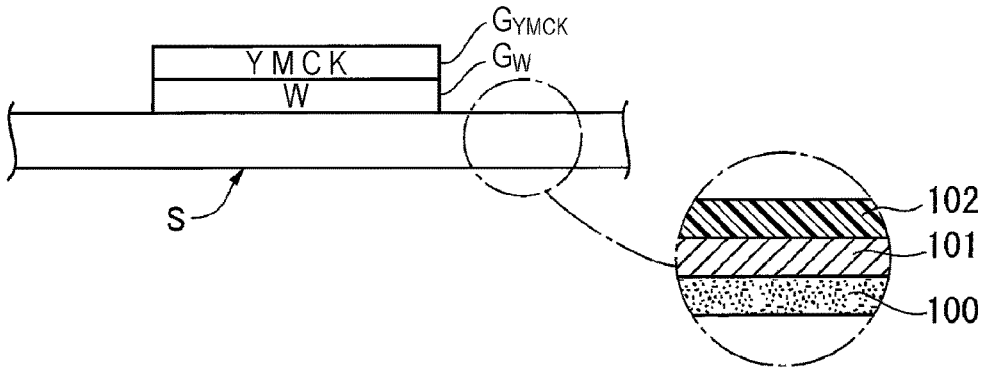
FIG. 4A is an explanatory diagram illustrating an Imaging Example 1 of forming an image onto low-resistance paper by the image forming device according to Exemplary Embodiment 1.

Herein, as illustrated in FIG. 4A, for example, a typical mode of the low-resistance paper sheet S is that which is designated so-called metallic paper, in which a metal layer 101 such as aluminum is laminated onto a substrate layer 100 made of a paper substrate, and in addition, the metal layer 101 is covered by a surface layer 102 made of a plastic such as PET. Note that an adhesive layer made of PET or the like may also be provided between the substrate layer 100 and the metal layer 101.

Some metallic papers of this type have a predetermined resistance value or less, but for example, for metallic paper provided with a surface layer 102 of a high-resistance material, even though the resistance value itself measured according to a sheet resistance measurement method conforming to JIS standards may not go below a threshold level, the metallic paper may act substantially like low-resistance paper when the transfer bias $V_{TR}$ is applied.

Figure 4B:
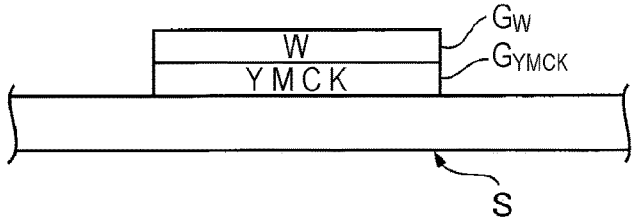
FIG. 4B is an explanatory diagram illustrating a similar Imaging Example 2.

On metallic paper acting as the low-resistance paper sheet S of this type, it is possible to form directly a color image made of YMCK (Yellow, Magenta, Cyan, Black), for example. However, as illustrated in FIG. 4A, for example, the image forming unit 22*f* illustrated in FIG. 2 for example may be used to form a white image $G_W$ as a background image made of white W on top of metallic paper, while in addition, the image forming units 22*b* to 22*e* illustrated in FIG. 2 for example may be used to form a color image $G_{YMCK}$ made of YMCK on top of the white image $G_W$. Alternatively, as illustrated in FIG. 4B, the image forming units 22*b* to 22*e* illustrated in FIG. 2 for example may be used to form the color image $G_{YMCK}$ made of YMCK on top of the metallic paper, while in addition, the image forming unit 22*a* illustrated in FIG. 2 may be used to form the white image $G_W$ made of white W on top of the color image $G_{YMCK}$.

—Exemplary Configuration of Discriminator—

Figure 4C:
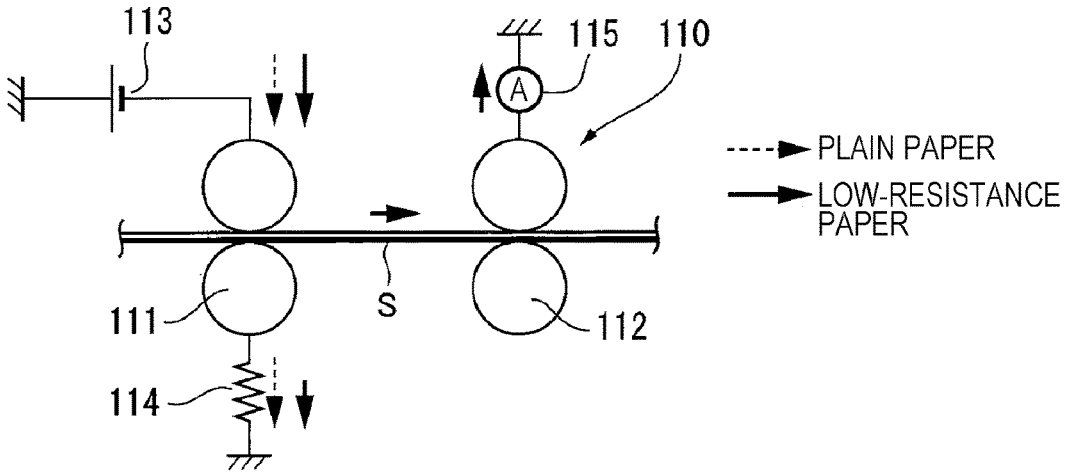
FIG. 4C is an explanatory diagram illustrating an example of the discriminator illustrated in FIG. 3.

In this example, as illustrated in FIG. 3, a discriminator 110 for discriminating the paper type is provided in a part of the vertical transport path 83 or the horizontal transport path 84 of the paper transport system 80. As illustrated in FIG. 4C, for example, in the discriminator 110, paired discrimination rollers 111 and 112 are arranged in parallel along the transport direction of the paper sheet S. With respect to the pair of discrimination rollers 111 positioned on the upstream side in the transport direction of the paper sheet S, a discrimination power source 113 is connected to one roller, while the other roller is grounded via a resistor 114. With respect to the other pair of discrimination rollers 112 positioned on the downstream side in the transport direction of the paper sheet S, a current meter 115 is provided between one roller and ground. Note that the members for transporting the paper sheet S (the registration rollers 90 and the transport rollers 91) may also double as the discrimination rollers 111 and 112, or may be provided separately from the transport members.

In this example, assuming that plain paper is used as the paper sheet S, for example, since the sheet resistance of plain paper is large to a certain extent, even if a plain paper sheet is disposed stretched between the pairs of discrimination rollers 111 and 112, as indicated by the dashed arrow in FIG. 4C, the discrimination current from the discrimination power source 113 flows cutting across the pair of discrimination rollers 111, and little to no current goes through the paper sheet S to reach the current meter 115 on the discrimination rollers 112 side.

In contrast, assuming that low-resistance paper such as metallic paper is used as the paper sheet S, since the sheet resistance of the low-resistance paper is small compared to plain paper, in the case in which a sheet of low-resistance paper is disposed stretched between the pairs of discrimination rollers 111 and 112, as indicated by the solid arrows in FIG. 4C, part of the discrimination current from the discrimination power source 113 flows cutting across the pair of discrimination rollers 111, and in addition, the rest of the discrimination current goes through the paper sheet S to reach the current meter 115 on the discrimination rollers 112 side. With the measured current measured by the current meter 115 and the applied voltage of the discrimination power source 113, the sheet resistance of the paper sheet S is computed, and the paper type is discriminated.

Note that this example is a mode in which the paper type is discriminated by having the discriminator 110 measure the sheet resistance of the paper sheet S during transport, but the paper type may also be discriminated on the basis of a specification signal when the paper type used by the user has been specified, for example.

—Drive Control System of Image Forming Device—

In the present exemplary embodiment, as illustrated in FIG. 3, the sign 120 denotes a control device that controls an imaging process of the image forming device. The control device 120 is made up of a microcomputer including a CPU, ROM, RAM, and an input/output interface. Through the input/output interface, various input signals are acquired, such as a switch signal from a start switch, a mode selection switch for selecting the imaging mode, and the like (not illustrated), various sensor signals, as well as a paper discrimination signal from the discriminator 110 that discriminates the paper type. An imaging control program (see FIG. 6) stored in advance in the ROM is executed by the CPU, and after generating control signals for the targets of drive control, the control signals are sent out to each target of drive control (such as the power source switch 59 and the toggle switch 61, for example).

—Operation of Image Forming Device—

Figure 6:
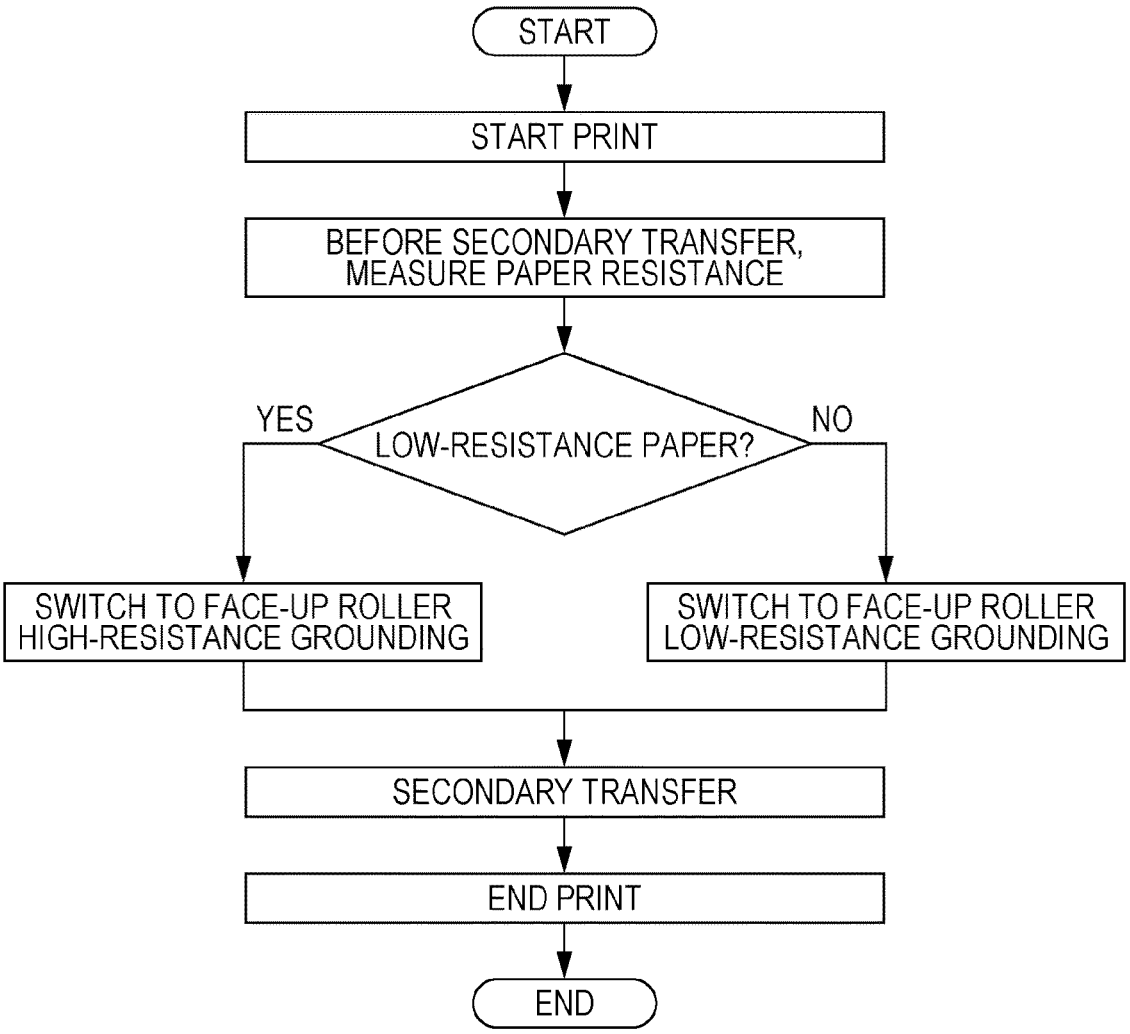
FIG. 6 is a flowchart illustrating a low-resistance paper imaging sequence used in the image forming device according to Exemplary Embodiment 1.

Now, in the image forming device illustrated in FIG. 2, supposing a case in which paper sheets S with different sheet resistance are mixed together and used, as illustrated in FIG. 6, by turning on the start switch (not illustrated), printing (an imaging process) by the image forming device is started.

At this time, the paper sheet S is supplied from one of the paper supply containers 81 and 82 or the manual feed paper supplier 95, and transported along a designated transport path towards the secondary transfer region TR. While the paper sheet S is being transported, before reaching the secondary transfer region TR, measurement of the sheet resistance of the paper sheet S by the discriminator 110 (the paper type discrimination process) is performed.

The control device 120 determines whether or not the paper sheet S is low-resistance paper on the basis of the discrimination result of the discriminator 110, and in the case of low-resistance paper, the control device 120 uses the toggle switch 61 to switch the grounding condition of the face-up roller 60 to high-resistance grounding.

On the other hand, if the paper sheet S is discriminated and determined not to be low-resistance paper, the control device 120 uses the toggle switch 61 to switch the grounding condition of the face-up roller 60 to low-resistance grounding.

After that, when the paper sheet S reaches the secondary transfer region TR, an image G transferred formed by each of the image forming units 22 (22*a* to 22*f*) and transferred onto the intermediate transfer body 30 by the first transfer is then transferred onto the paper sheet S by the secondary transfer, and after going through the fusing process by the fusing device 70, the paper sheet S is delivered in the paper delivery receptacle 86, and the series of printing operating (imaging process) ends.

—Secondary Transfer Operation Sequence—

<Plain Paper>

Now, in the case in which the paper sheet S is plain paper, as illustrated in FIG. 3, the grounding condition of the face-up roller 60 is set to low-resistance grounding, the paper sheet S reaches the secondary transfer region TR via the guide chutes 92 and 93, and in the secondary transfer region TR, the image G on the intermediate transfer body 30 is transferred to the paper sheet S by the secondary transfer. At this time, when the paper sheet S exits the guide chute 93 positioned close to the secondary transfer region TR, the trailing end of the paper sheet S jumps up and contacts the part of the intermediate transfer body 30 fronting the face-up roller 60. However, since the sheet resistance of the paper sheet S is large to a certain extent, even though the face-up roller 60 is grounded at low resistance, part of the transfer current in the secondary transfer region TR does not leak along a conductive path leading from the face-up roller 60 to ground with the paper sheet S acting as a conductive path. Instead, the transfer operation with respect to the paper sheet S in the secondary transfer region TR is performed stably, and trouble such as lowered image density at the trailing end of the paper sheet S does not occur.

<Low-Resistance Paper>

Next, the case in which the paper sheet S is low-resistance paper (for example, metallic paper) will be described.

Figure 7A:
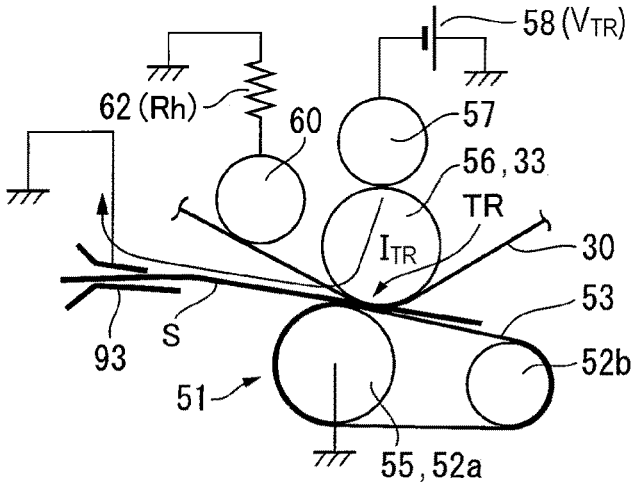

Now, assuming that the trailing end of the low-resistance paper sheet S has not yet passed through the guide chute 93, as illustrated in FIG. 7A, the low-resistance paper sheet S is disposed stretched between the secondary transfer region TR and the guide chute 93. At this time, the transfer current $I_{TR}$ from the transfer power source 58 becomes leakage current leading from the guide chute 93 to ground with the low-resistance paper sheet S acting as a conductive path, but since the transfer current $I_{TR}$ flows stably from the opposing roller 56 to the low-resistance paper sheet S side through the intermediate transfer body 30, in the secondary transfer region TR, a transfer electric field pointing towards the low-resistance paper sheet S acts on the image G on the intermediate transfer body 30, and stable secondary transfer operations are performed.

Figure 9A:
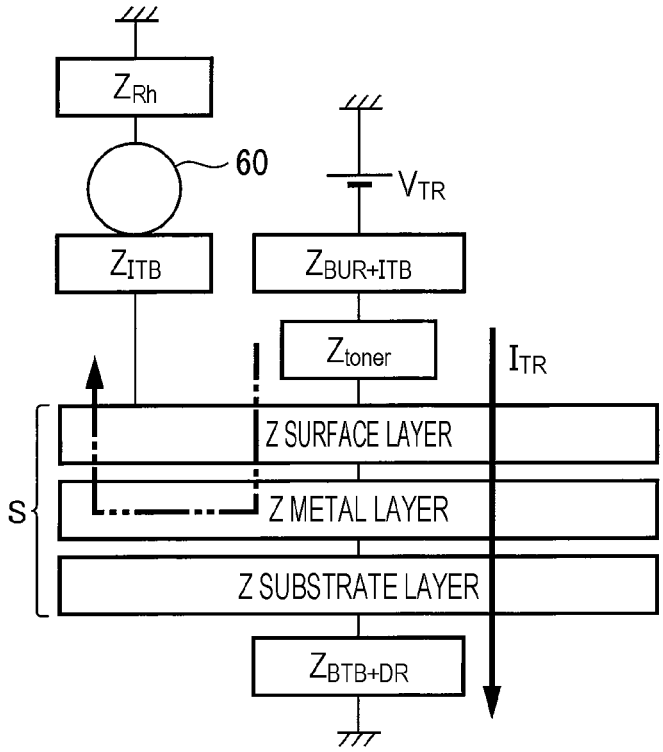
FIG. 9A is an explanatory diagram schematically illustrating the flow of a transfer current of a transfer operation sequence with respect to low-resistance paper by the image forming device according to Exemplary Embodiment 1.

In this state, in the present exemplary embodiment, as illustrated in FIG. 9A, the grounding condition of the face-up roller 60 is selectively switched to high-resistance grounding using the high resistance 62.

Figure 7B:
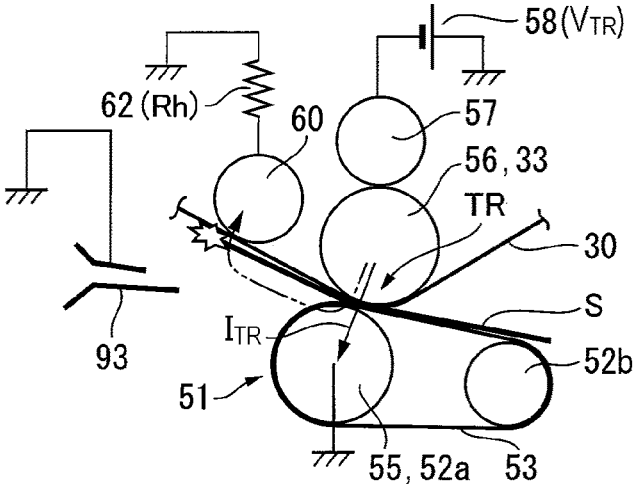

Next, when the low-resistance paper sheet S passes through the guide chute 93, as illustrated in FIG. 7B, the trailing end of the low-resistance paper sheet S jumps up and contacts the part of the intermediate transfer body 30 facing opposite the face-up roller 60. At this time, the low-resistance paper sheet S is disposed stretched between the secondary transfer region TR and the face-up roller 60, but since the face-up roller 60 is grounded at high resistance, part of the transfer current $I_{TR}$ in the secondary transfer region TR does not become a leakage current going from the face-up roller 60 to ground with the low-resistance paper sheet S acting as a conductive path.

In other words, the impedance of each element around the secondary transfer region TR of the present exemplary embodiment is defined as follows, and FIG. 9A schematically illustrates an equivalent circuit.

$Z_{BUR+ITB}$: impedance of opposing roller 56+intermediate transfer body 30

$Z_{BTB+DR}$: impedance of belt transfer module 51 (transfer transport belt 53+elastic transfer roller 55)

$Z_{ITB}$: impedance of intermediate transfer body 30

$Z_{toner}$: impedance of toner $Z_{Rh}$: impedance of high resistance 62

Z substrate layer: impedance of substrate layer 100 of low-resistance paper sheet S Z metal layer: impedance of metal layer 101 of low-resistance paper sheet S Z surface layer: impedance of surface layer 102 of low-resistance paper sheet S Note that in FIG. 9A, the sign 60 indicates the face-up roller, $V_{TR}$ indicates the transfer voltage, and $I_{TR}$ indicates the transfer current.

In the equivalent circuit illustrated in the diagram, when the transfer voltage $V_{TR}$ is applied to the secondary transfer region TR, the transfer current $I_{TR}$ flows between the opposing roller 56 and the belt transfer module 51. At this time, since the impedance of the metal layer 101 of the low-resistance paper sheet S is low, there is a possibility of part of the transfer current $I_{TR}$ flowing to the face-up roller 60 side with the metal layer 101 acting as a conductive path, but since the face-up roller 60 is grounded at high resistance, there is little to no risk of part of the transfer current $I_{TR}$ leaking via the face-up roller 60 along the conductive path indicated by the chain line in FIG. 9A.

For this reason, even if a tiny gap occurs between the trailing end of the low-resistance paper sheet S and the intermediate transfer body 30 due to unstable contact with the intermediate transfer body 30 caused by the jumping up of the trailing end of the low-resistance paper sheet S, electric discharge does not occur in the portion of the tiny gap, and there is little to no risk of imparting fluctuations to the toner charge amount on the intermediate transfer body 30.

Figure 7C:
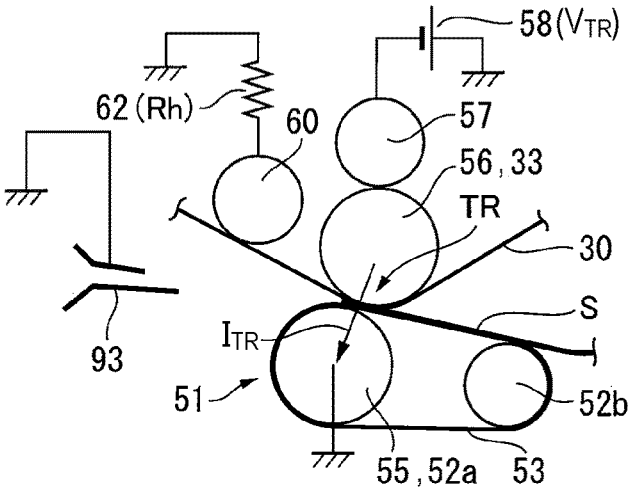

After that, in the case in which the trailing end of the low-resistance paper sheet S passes through the secondary transfer region TR, as illustrated in FIG. 7C, the toner image G on the intermediate transfer body 30 corresponding to the trailing end of the low-resistance paper sheet S is not charged up, and stable secondary transfer operations are performed with the transfer voltage $V_{TR}$ applied from the transfer power source 58 acting as an optimal transfer voltage.

For this reason, in the present exemplary embodiment, even if a halftone image of uniform density is printed over approximately the entire area of the low-resistance paper sheet S, the toner image G on the intermediate transfer body 30 corresponding to the trailing end of the low-resistance paper sheet S is not charged up, and there is little to no risk of a local reduction in image density in the trailing end portion of the low-resistance paper sheet S.

Comparative Embodiment 1

Next, after evaluating the performance due to the configuration around the secondary transfer region TR according to the present exemplary embodiment, the performance due to a configuration around the secondary transfer region TR according to Comparative Embodiment 1 will be described.

Figure 8A:
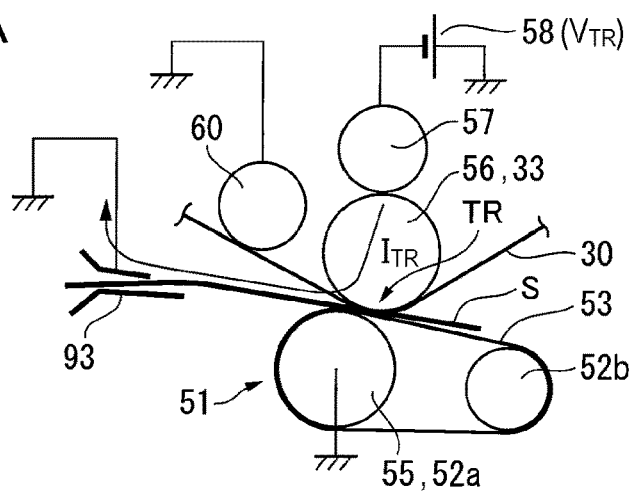

As illustrated in FIG. 8A, the basic configuration around the secondary transfer region TR according to Comparative Embodiment 1 is approximately similar to Exemplary Embodiment 1, but unlike Exemplary Embodiment 1, even in the case of using a low-resistance paper sheet S such as metallic paper, the face-up roller 60 is directly grounded without going through the high resistance 62. Note that the structural elements similar to Exemplary Embodiment 1 are denoted with similar signs as Exemplary Embodiment 1, and detailed description thereof will be omitted.

As illustrated in FIG. 8A, assuming that the trailing end of the low-resistance paper sheet S has not yet passed through the guide chute 93, the low-resistance paper sheet S is disposed stretched between the secondary transfer region TR and the guide chute 93, approximately similar to Exemplary Embodiment 1. Thus, in the secondary transfer region TR, the transfer current $I_{TR}$ from the transfer power source 58 becomes a leakage current going from the guide chute 93 to ground with the low-resistance paper sheet S acting as a conductive path, but since the transfer current $I_{TR}$ flows stably from the opposing roller 56 to the low-resistance paper sheet S side via the intermediate transfer body 30, stable secondary transfer operations are performed in the secondary transfer region TR.

Figure 8B:
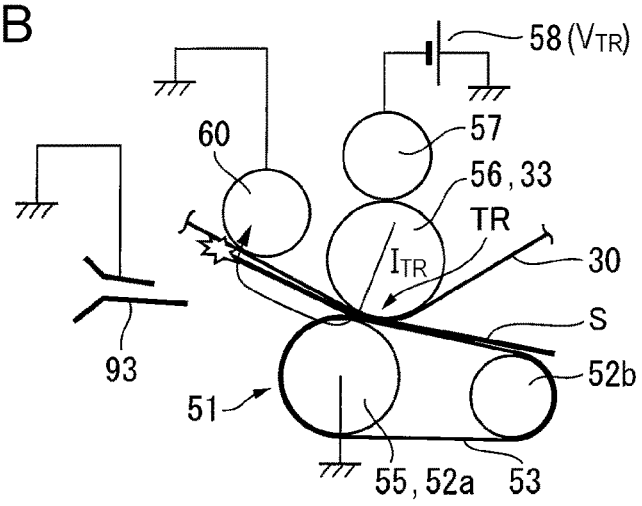

Next, when the low-resistance paper sheet S passes through the guide chute 93, as illustrated in FIG. 8B, the trailing end of the low-resistance paper sheet S jumps up and contacts the part of the intermediate transfer body 30 facing opposite the face-up roller 60. At this time, since the low-resistance paper sheet S is disposed stretched between the secondary transfer region TR and the face-up roller 60, and moreover since the face-up roller 60 is grounded without going through the high resistance 62, the transfer current $I_{TR}$ in the secondary transfer region TR becomes a leakage current going from the face-up roller 60 to ground with the low-resistance paper sheet S acting as a conductive path.

Figure 9B:
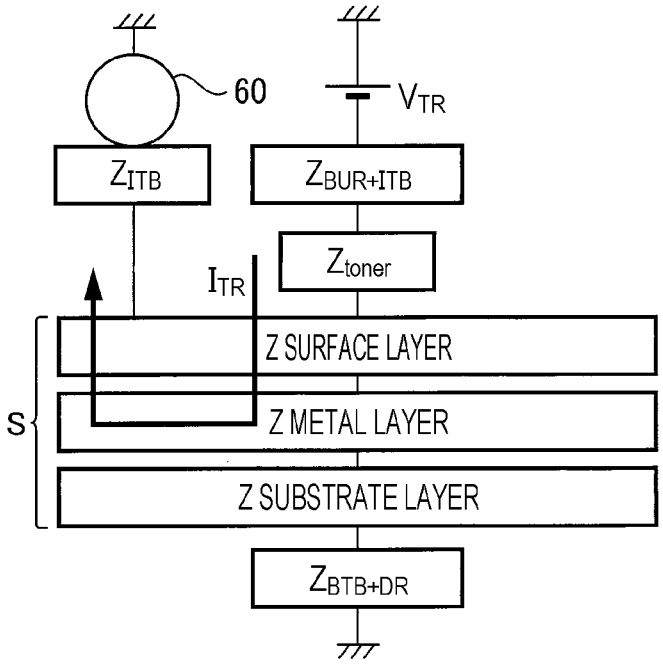
FIG. 9B is an explanatory diagram schematically illustrating the flow of a transfer current of a transfer operation sequence with respect to low-resistance paper by the image forming device according to Comparative Example 1.

Herein, FIG. 9B illustrates an equivalent circuit of each element around the secondary transfer region TR in Comparative Embodiment 1. Note that the impedance of each element in the FIG. 9B is denoted similarly to that defined in FIG. 9A.

In the diagram, when the transfer voltage $V_{TR}$ is applied to the secondary transfer region TR, since the impedance of the metal layer of the low-resistance paper sheet S is low, and the face-up roller 60 is grounded without going through the high resistance 62, the transfer current $I_{TR}$ becomes a leakage current going to ground via the face-up roller 60 along the conductive path illustrated by the solid line in FIG. 9B.

In this state, even if the trailing end of the low-resistance paper sheet S jumps up and contacts the part of the intermediate transfer body 30 facing opposite the face-up roller 60, the contact state is unstable, and there is a risk of a tiny gap occurring between the trailing end of the low-resistance paper sheet S and the intermediate transfer body 30. If the leakage current tries to flow in the state in which such a tiny gap exists, electric discharge occurs at the location of the tiny gap, and by consequence, there is a risk of imparting fluctuations to the toner charge amount on the intermediate transfer body 30.

Figure 8C:
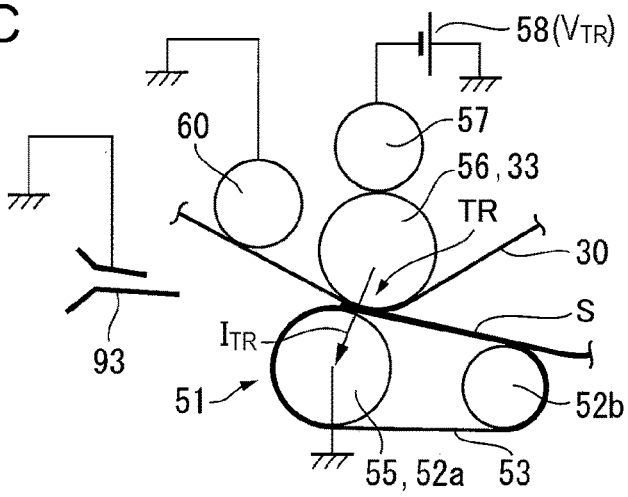
Figure 10:
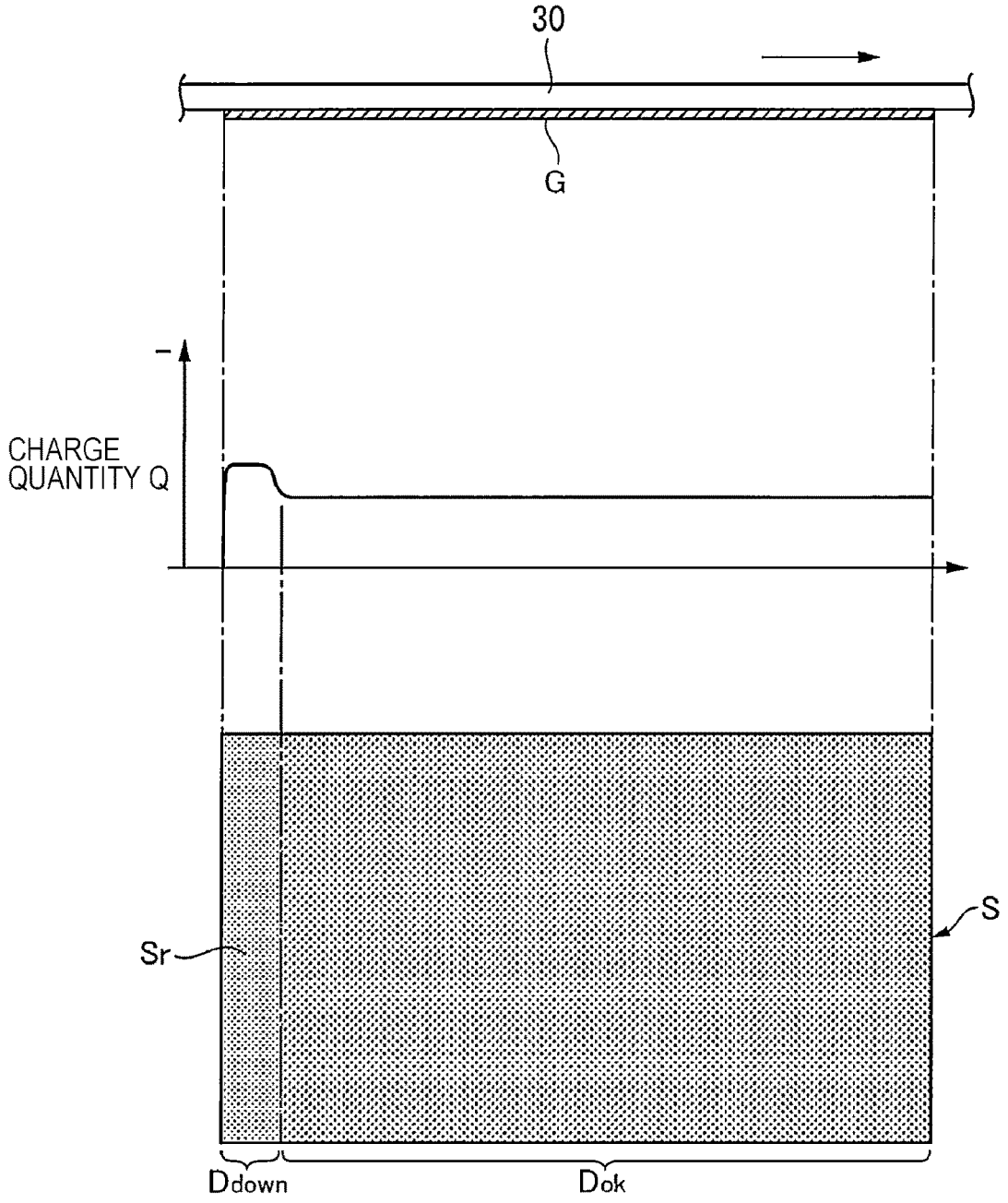
FIG. 10 is an explanatory diagram illustrating the cause of an example of image quality trouble which may occur during a transfer operation to low-resistance paper by the image forming device according to Comparative Embodiment 1.

After that in the case in which the trailing end of the low-resistance paper sheet S passes through the secondary transfer region TR, as illustrated in FIG. 8C and FIG. 10, the toner image G on the intermediate transfer body 30 corresponding to the trailing end of the low-resistance paper sheet S is charged up, thereby causing the charge amount Q of the toner image G at the trailing end of the low-resistance paper sheet S to increase locally. Consequently, even if the constant-voltage transfer voltage $V_{TR}$ from the transfer power source 58 is applied, the transfer electric field (the transfer current $I_{TR}$) may be insufficient with respect to the charged-up toner image G. For example, even if one attempts to form an image G of uniform density over approximately the entire area of the low-resistance paper sheet S, there is a risk of image quality trouble occurring in which the image density transferred onto the trailing end Sr of the low-resistance paper sheet S becomes a lower density Ddown than the image density Dok in the other portions.

Comparative Embodiment 2

In Comparative Embodiment 2, in the case of using a low-resistance paper sheet S such as metallic paper, the face-up roller 60 is selectively switched to a non-grounded state (floating state).

In this comparative embodiment, the phenomenon of lowered image density at the trailing end of the low-resistance paper sheet S like in Comparative Embodiment 1 is not observed, but there are separate risks associated with the floating ground of the face-up roller 60.

(1) Electric discharge from the face-up roller 60 due to the accumulation of charge in the face-up roller 60 occurs more easily.
(2) If an electric discharge occurs in the tiny gap portion between the face-up roller 60 and the intermediate transfer body 30, fluctuations are imparted to the toner charge amount on the intermediate transfer body 30, which risks leading to degraded image quality when during transfer in the secondary transfer region TR.
(3) The advantages of configuring the face-up roller 60 with a grounded structure, such as decreased electrical noise as a result of cutting off leakage current from the face-up roller 60, are lost.

Modifications 1 and 2

In the present exemplary embodiment, in the case of using a low-resistance paper sheet S such as metallic paper, the face-up roller 60 is selectively switched to high-resistance grounding using a resistance element. However, the configuration is not limited thereto, and as illustrated in Modifications 1 and 2, it is also possible to use an element that reduces the amount of current leading from the face-up roller 60 to ground.

Figure 5C:
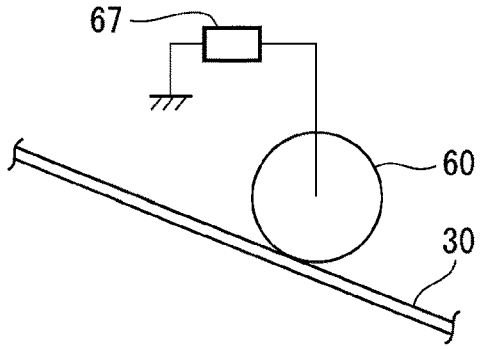
FIG. 5C is an explanatory diagram illustrating Modification 1 of a reducing element that reduces the amount of current leading from the face-up roller to ground.

In Modification 1, as illustrated in FIG. 5C, a current-restricting element 67 such as a diode is interposed between the face-up roller 60 and ground, and leakage current proceeding from the face-up roller 60 to ground is hindered by the current-restricting element 67.

Figure 5D:
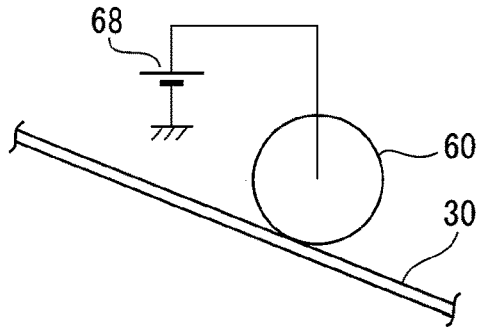
FIG. 5D is an explanatory diagram illustrating Modification 2 of the reducing element.

In Modification 2, as illustrated in FIG. 5D, by providing an inverse-polarity power source 68 between the face-up roller 60 and ground, leakage current from the face-up roller 60 is cut off by the inverse-polarity voltage from the inverse-polarity power source 68.

WORKING EXAMPLES

Working Example 1

Working Example 1 embodies the image forming device according to Exemplary Embodiment 1.

Figure 11A:
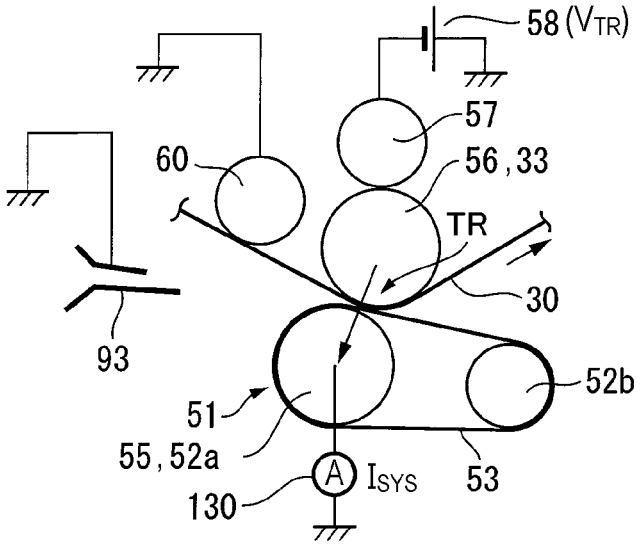
FIG. 11A is an explanatory diagram illustrating an exemplary measurement circuit for measuring the system resistance of a secondary transfer unit of the image forming device according to Working Example 1.

FIG. 11A illustrates an exemplary measurement circuit that measures the system resistance of the secondary transfer region TR in the image forming device according to Working Example 1.

In the diagram, the system resistance $R_{SYS}$ of the secondary transfer region TR (the combined resistance of the opposing roller 56, the intermediate transfer body 30, and the belt transfer module 51) is computable by applying the transfer voltage $V_{TR}$ from the transfer power source 58 without interposing the paper sheet S in the secondary transfer region TR, measuring the current $I_{SYS}$ passing through the secondary transfer region TR at the time with a current meter 130, and calculating the transfer voltage $V_{TR}$ divided by the current $I_{SYS}$.

In this working example, the system resistance $R_{SYS}$ is 20.2 MΩ.

Figure 11B:
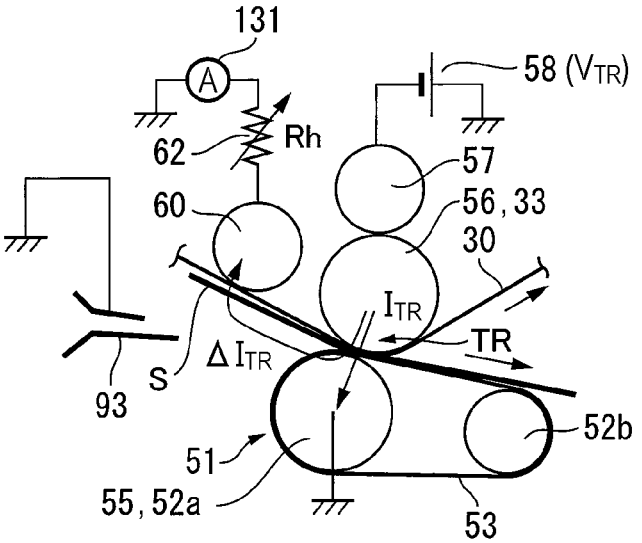
FIG. 11B is an explanatory diagram illustrating an exemplary measurement circuit for measuring leakage current when the image forming device according to Working Example 1 is used, and the high resistance connected to the face-up roller is made variable.

Also, FIG. 11B illustrates an exemplary measurement circuit in which, when a low-resistance paper sheet S such as metallic paper is used, the resistance value Rh (corresponding to the ground resistance) of the high resistance 62 used in the high-resistance grounding of the face-up roller 60 is varied, secondary transfer operations (the generation of the transfer current $I_{TR}$ by the application of the transfer voltage $V_{TR}$) are performed with respect to the low-resistance paper sheet S in the secondary transfer region TR, and in addition, at the point in time when the low-resistance paper sheet S exits the guide chute 93, each leakage current $\Delta I_{TR}$ is measured with a current meter 131.

Figure 12A:
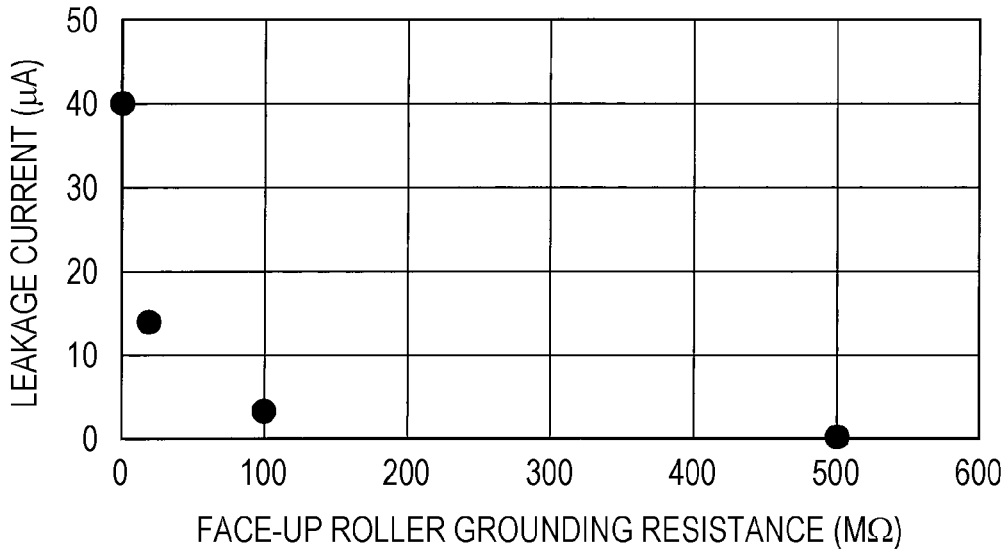
FIG. 12A is an explanatory diagram illustrating the relationship between the grounding resistance of the face-up roller and the leakage current by the image forming device according to Working Example 1.

The measurement results of the grounding resistance of the face-up roller 60 and the leakage current $\Delta I_{TR}$ in FIG. 11B are illustrated in FIG. 12A.

As revealed by the graph, under the condition of setting the grounding resistance of the face-up roller 60 to 100 MΩ, the leakage current $\Delta I_{TR}$ approaches approximately 0, and starting from approximately a grounding condition exceeding 100 MΩ, the leakage current $\Delta I_{TR}$ is 0.

Figure 12B:
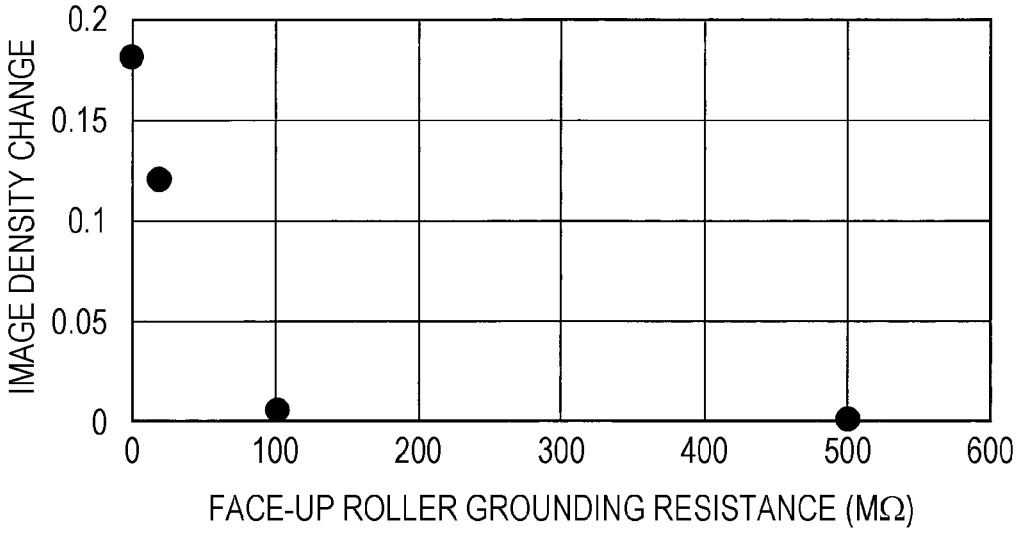
FIG. 12B is an explanatory diagram illustrating the relationship between the grounding resistance of the face-up roller and the image density change at the trailing end of a paper sheet by the image forming device.

Also, an investigation of the relationship between the grounding resistance of the face-up roller 60 and image density change, specifically density change at the trailing end of the low-resistance paper sheet S, yielded the results illustrated in FIG. 12B.

As revealed by the graph, under the condition of setting the grounding resistance of the face-up roller 60 to 100 MΩ, the image density changes approaches approximately 0, and starting from a grounding condition exceeding 100 MΩ, the image density change is 0.

In this way, in the present example, when the system resistance $R_{SYS}$ in the secondary transfer region TR is 20.2MΩ, under the condition by which the grounding resistance of the face-up roller 60 exceeds 100 MΩ, the leakage current $\Delta I_{TR}$ and the image density change are confirmed to be 0.

Note that even for a separate image forming device having a different system resistance $R_{SYS}$ in the secondary transfer region TR, when similar experiments are performed, a tendency similar to Working Example 1 is observed.

In other words, it is demonstrated that for grounding resistance of the face-up roller 60, choosing a resistance value that is five times or greater than the system resistance $R_{SYS}$ of the secondary transfer region TR is beneficial.

Working Example 2

Working Example 2 uses an image forming device similar to Working Example 1, and sets the system resistance $R_{SYS}$ of the secondary transfer region TR to 20.2 MΩ, and the grounding resistance of the face-up roller 60 to 100 MΩ when using a low-resistance paper sheet S such as metallic paper.

Comparative Examples 1 and 2

In Comparative Example 1, the grounding resistance of the face-up roller 60 is 0 when using a low-resistance paper sheet S, or in other words, the face-up roller 60 is directly grounded.

In Comparative Example 2, the face-up roller 60 is set to a non-grounded state (floating state) when using the low-resistance paper sheet S.

Figure 13:
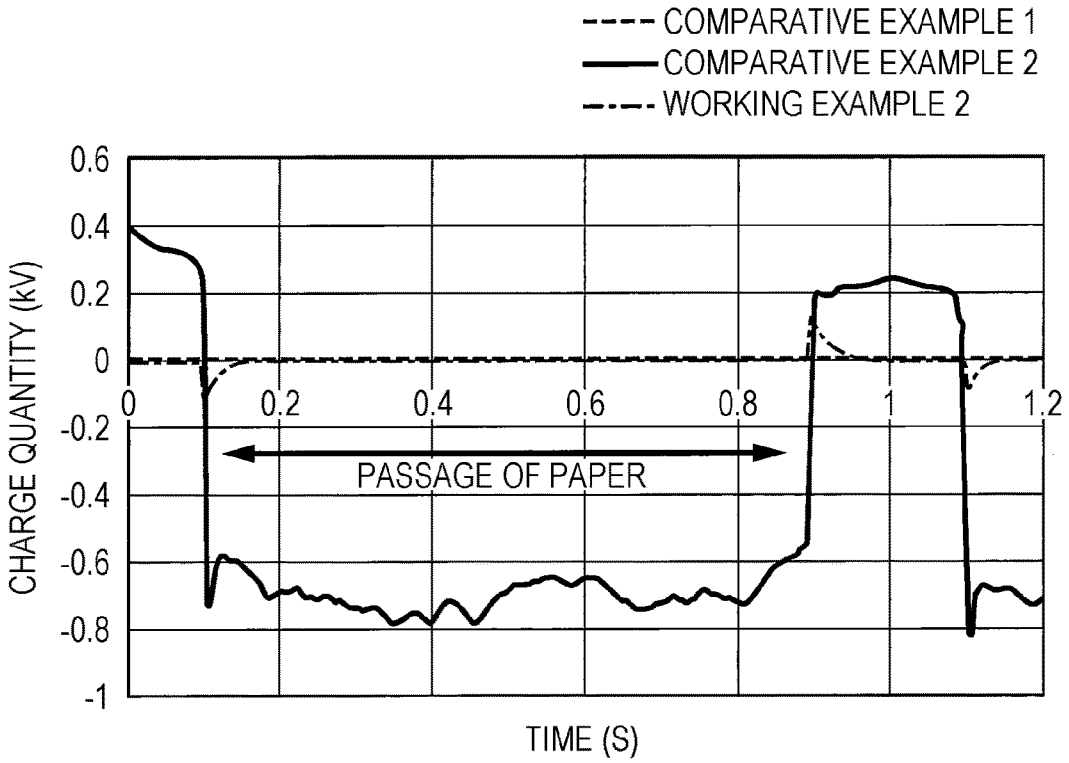
FIG. 13 is an explanatory diagram illustrating the change in the charge amount of the face-up roller with respect to the image forming device according to Working Example 2, and the image forming device according to Comparative Examples 1 and 2.

Additionally, for Working Example 2 and Comparative Examples 1 and 2, the charge amount of the face-up roller 60 when performing secondary transfer operations with respect to the low-resistance paper sheet S is measured, and the results illustrated in FIG. 13 are obtained.

At this time, in Comparative Example 1 (grounding resistance 0) the charge level of the face-up roller 60 is 0, but in Comparative Example 2 (floating state), the face-up roller 60 is observed to exhibit potential change tracking the transfer voltage $V_{TR}$.

In contrast, in Working Example 2, although the charge level of the face-up roller 60 rises, and changes in the rise are observed, the charge level is 0, approximately similar to Comparative Example 1. In this way, even if the face-up roller 60 is grounded at high resistance, the charge amount of the face-up roller 60 is confirmed to be maintained at 0.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a thin-walled image carrier that movably carries an image formed by charged imaging particles;

a transfer device, disposed in contact with an image-carrying face of the image carrier, configured to transport a recording medium held between the transfer device and the image carrier, and in addition, configured to apply a transfer voltage to a transfer region between the transfer device and the image carrier to thereby cause the image held on the image carrier to be transferred to the recording medium;

a face-forming member, disposed in contact with a back face of the image carrier further on an upstream side in a movement direction of the image carrier than the transfer region of the transfer device, the face-forming member being provided grounded along a direction intersecting the movement direction of the image carrier, and including a conductive member that forms a movement track face of the image carrier leading to the transfer region;

a reducing element, provided on a current path going through the face-forming member configured to reduce an amount of current leading from the face-forming member to ground, wherein when the recording medium is of low resistance, having a predetermined resistance value or less, or having a conductive layer along a medium substrate face, the reducing element is selectively switched to a current path leading from the face-forming member to ground.

2. The image forming device according to claim 1, wherein the reducing element interposes a resistance element between the face-forming member and ground.

3. The image forming device according to claim 2, wherein the resistance element has a resistance value greater than the resistance value of the transfer device.

4. The image forming device according to claim 3, wherein the resistance value of the resistance element is five times or greater than the resistance value of the transfer device.

5. The image forming device according to claim 2, wherein the resistance element has a resistance value greater than the resistance value of the recording medium.

6. The image forming device according to claim 1, wherein the recording medium is guided to the transfer region along the image carrier after making contact with a portion of the image carrier further on the upstream side in the movement direction of the image carrier than the transfer region and also further on a downstream side in the movement direction of the image carrier than the face-forming member, via a running guide member disposed further on the upstream side in a transport direction than the transfer region of the transfer device.

7. The image forming device according to claim 6, wherein after passing through the running guide member, a trailing end part of the recording medium makes contact facing a part of the image carrier facing opposite to the face-forming member.

8. The image forming device according to claim 1, wherein the recording medium is of low resistance, having a predetermined resistance value or less, or having a conductive layer along a medium substrate face.

9. The image forming device according to claim 1, wherein the image carrier is an intermediate transfer body onto which an image on an image-forming carrier is intermediately transferred and held before being transferred onto a recording medium, and the transfer device transfers the image on the intermediate transfer body onto the recording medium.

10. The image forming device according to claim 1, further comprising:

a medium discriminator that discriminates whether or not the recording medium is of low resistance having a predetermined resistance value or less, or having a conductive layer along a medium substrate face; and a switch mechanism that selectively switches the reducing element to a current path leading from the face-forming member to ground when the medium discriminator discriminates that the recording medium is of low resistance.

11. The image forming device according to claim 1, wherein the running guide member including an upper part and a lower part, the upper part and the lower part are both grounded.

12. The image forming device according to claim 1, further comprising:

a running guide member, disposed in an entrance side of the transfer region, configured to guide the recording medium to the transfer region, wherein at least an upper part of the running guide member is grounded.

13. An image forming device comprising:

a thin-walled image carrier that movably carries an image formed by charged imaging particles;

transfer means, disposed in contact with an image-carrying face of the image carrier, for transporting a recording medium held between the transfer means and the image carrier, and in addition, applying a transfer voltage to a transfer region between the transfer means and the image carrier to thereby cause the image held on the image carrier to be transferred to the recording medium;

a face-forming member, disposed in contact with a back face of the image carrier further on an upstream side in a movement direction of the image carrier than the transfer region of the transfer means, the face-forming member being provided grounded along a direction intersecting the movement direction of the image carrier, and including a conductive member that forms a movement track face of the image carrier leading to the transfer region;

reducing means, provided on a current path going through the face-forming member, for reducing an amount of current leading from the face-forming member to ground, wherein when the recording medium is of low resistance, having a predetermined resistance value or less, or having a conductive layer along a medium substrate face, the reducing element is selectively switched to a current path leading from the face-forming member to ground.

14. The image forming device according to claim 13, further comprising:

a running guide member, disposed in an entrance side of the transfer region, configured to guide the recording medium to the transfer region, wherein at least an upper part of the running guide member is grounded.

* * * * *